US008391536B2

(12) United States Patent
Hashimoto

(10) Patent No.: US 8,391,536 B2
(45) Date of Patent: Mar. 5, 2013

(54) EARPHONE DEVICE AND EARPHONE DEVICE MAIN BODY

(75) Inventor: Junichi Hashimoto, Osaka (JP)

(73) Assignee: Panasonic Corporation, Osaka (JP)

( * ) Notice: Subject to any disclaimer, the term of this patent is extended or adjusted under 35 U.S.C. 154(b) by 232 days.

(21) Appl. No.: 13/059,201

(22) PCT Filed: Apr. 22, 2010

(86) PCT No.: PCT/JP2010/002907

§ 371 (c)(1),
(2), (4) Date: Feb. 15, 2011

(87) PCT Pub. No.: WO2010/131426

PCT Pub. Date: Nov. 18, 2010

(65) Prior Publication Data

US 2011/0176700 A1 Jul. 21, 2011

(30) Foreign Application Priority Data

May 13, 2009 (JP) ..... 2009-116123

(51) Int. Cl.
*H04R 25/00* (2006.01)

(52) U.S. Cl. ..... 381/380; 381/382; 381/370

(58) Field of Classification Search ..... 381/322, 381/325–326, 328, 370, 380–382; 181/129–135
See application file for complete search history.

(56) References Cited

U.S. PATENT DOCUMENTS

| | | | | |
|---|---|---|---|---|
| 7,512,243 | B2 * | 3/2009 | Haussmann | 381/380 |
| 7,551,748 | B2 * | 6/2009 | Kamo et al. | 381/380 |
| 2007/0189570 | A1 | 8/2007 | Matsuo et al. | |
| 2008/0187161 | A1 | 8/2008 | Tiemens et al. | |

FOREIGN PATENT DOCUMENTS

| | | |
|---|---|---|
| JP | 09-065476 | 3/1997 |
| JP | 2005-191663 | 7/2005 |
| JP | 2007-189468 | 7/2007 |
| JP | 2008-193687 | 8/2008 |
| JP | 2008-277909 | 11/2008 |
| JP | 2009-055248 | 3/2009 |

* cited by examiner

*Primary Examiner* — Suhan Ni
(74) *Attorney, Agent, or Firm* — McDermott Will & Emery LLP

(57) ABSTRACT

An earphone device includes a case main body, a sound conduit, and an ear tip. The sound conduit is formed in a substantially tubular shape and protrudes from the case main body. The sound conduit has a flange disposed at the end on the opposite side from the case main body, and a first restrictor disposed between the flange and the case main body. The ear tip has a ring part formed of a resilient material and configured to be engaged to the sound conduit. The ear tip is configured to be in a first state in which movement in the direction of removal from the sound conduit is restricted by the flange, and is configured to be in a second state in which movement in the direction of removal from the sound conduit is restricted by the first restrictor.

20 Claims, 6 Drawing Sheets

EARPHONE DEVICE AND EARPHONE DEVICE MAIN BODY

CROSS-REFERENCE TO RELATED APPLICATIONS

This application is the U.S. National Phase under 35 U.S.C. §371 of International Application No. PCT/JP2010/002907, filed on Apr. 22, 2010, which in turn claims the benefit of Japanese Application No. 2009-116123, filed on May 13, 2009, the disclosures of which Applications are incorporated by reference herein.

TECHNICAL FIELD

The present invention relates to an earphone device, and more particularly an earphone device used in a state of being inserted into the outer ear canal of the user, and to an earphone device main body used for an earphone device.

BACKGROUND ART

Insertion-type earphone devices that are used in a state in which a part is inserted into the outer ear canal of the user have come into widespread use in recent years (see Patent Literature 1 and 2, for example). This type of earphone device has a sound generator that generates sound by receiving the input of electrical signals, a case main body that houses the sound generator, a sound conduit that sticks out from the case main body, and an ear tip. The ear tip is formed from a resilient material (such as soft rubber) and can be attached to the sound conduit. When the user uses the earphone device, the ear tip is attached to the sound conduit, and the sound conduit is inserted into the outer ear canal of the user in a state of being covered by the ear tip. Sound generated by the sound generator is transmitted through a hole formed in the sound conduit, and is emitted from the distal end of the ear tip of the earphone device.

With the earphone devices disclosed in Patent Literature 1 and 2, the ear tip is fixed to the sound conduit by being fitted into the sound conduit.

The insertion type of earphone device discussed above is used in a state in which the ear tip is disposed so as to block off the outer ear canal of the user. This reduces the effect of external noise and helps to improve sound quality. The ear tip also functions as a cushioning member, which prevents the sound conduit from coming into contact with the outer ear canal of the user.

Meanwhile, there is also a known earphone device that takes into account the great variety of shapes and sizes in the outer ear canal of users. For instance, a plurality of ear tips of different size and design may be provided as accessory parts to an earphone device so that the user can replace the ear tip to match personal preference or the size of the outer ear canal.

Patent Literature 1: Japanese Laid-Open Patent Application 2005-191663

Patent Literature 2: Japanese Laid-Open Patent Application 2007-189468

SUMMARY

However, when the ear tip is merely fitted to the sound conduit, there is the possibility that the ear tip will easily fall off from the sound conduit. That is, with a conventional earphone device, the ear tip cannot be fixed to the sound conduit securely enough to prevent the ear tip from falling off the sound conduit.

An earphone device disclosed herein comprises a case main body, a sound conduit, and an ear tip. The sound conduit is formed in a substantially tubular shape and protrudes from the case main body. The sound conduit has a flange disposed at the end on the opposite side from the case main body, and a first restrictor disposed between the flange and the case main body. The ear tip has a ring part formed of a resilient material and configured to be engaged to the sound conduit. The ear tip is configured to be in a first state in which movement in the direction of removal from the sound conduit is restricted by the flange, and is configured to be in a second state in which movement in the direction of removal from the sound conduit is restricted by the first restrictor.

The term "tubular" here refers to the shape of a member in which a through-hole is formed. When the tubular member is cut in the direction in which the through-hole extends (hereinafter referred to as the through direction), the cross section extends longer in the through direction. Therefore, "tubular" is a concept that encompasses shapes other than that of a cylinder, and is a concept that encompasses a case in which a cross section perpendicular to the through direction is elliptical, for example.

DESCRIPTION OF EMBODIMENTS

First Embodiment

The earphone device 100 according to a first embodiment will now be described through reference to the drawings.

1.1: Configuration

Figure 1:
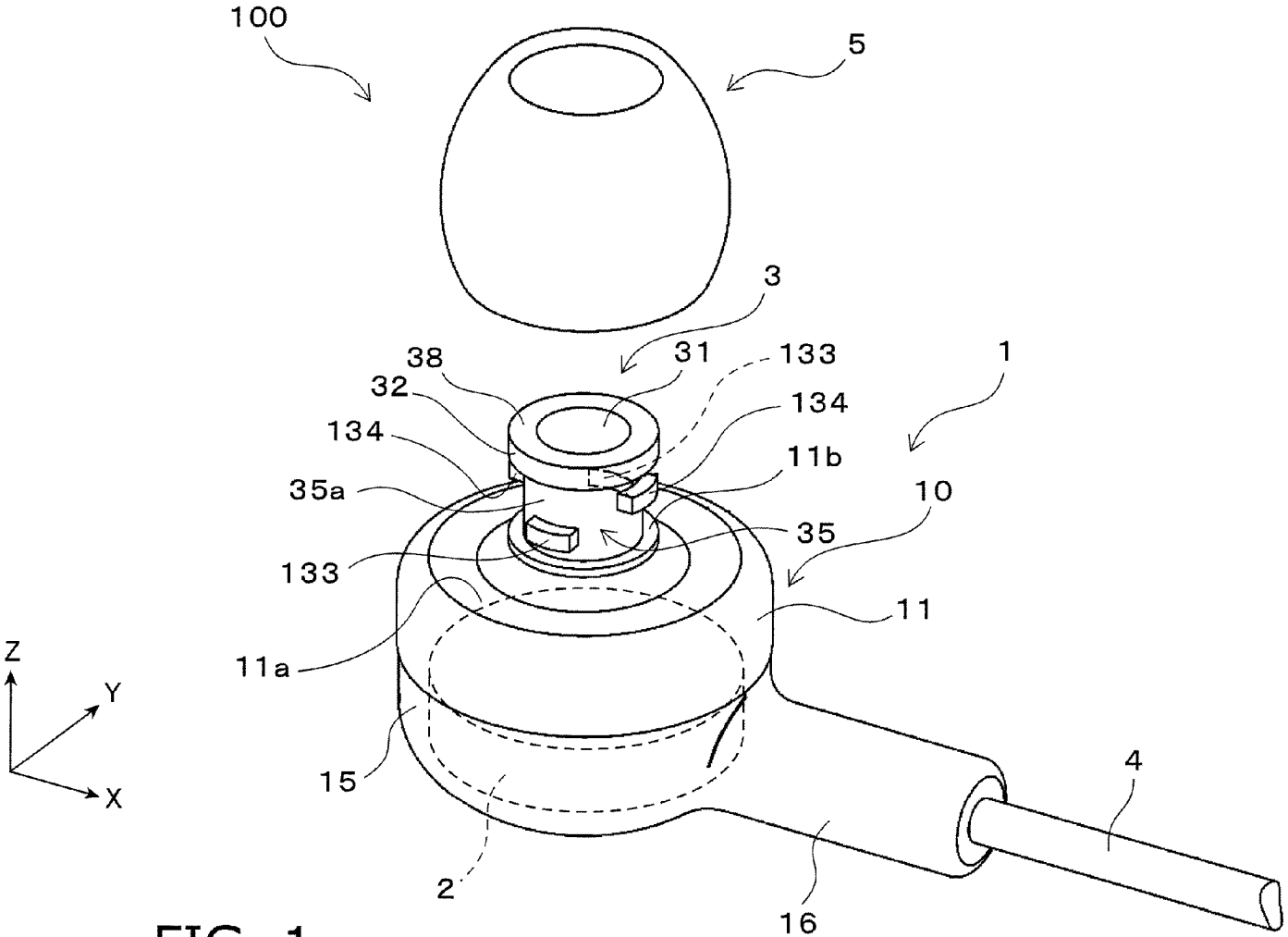
FIG. 1 is an oblique view of an earphone device 100 in a state in which an ear tip 5 has not been attached.
Figure 2:
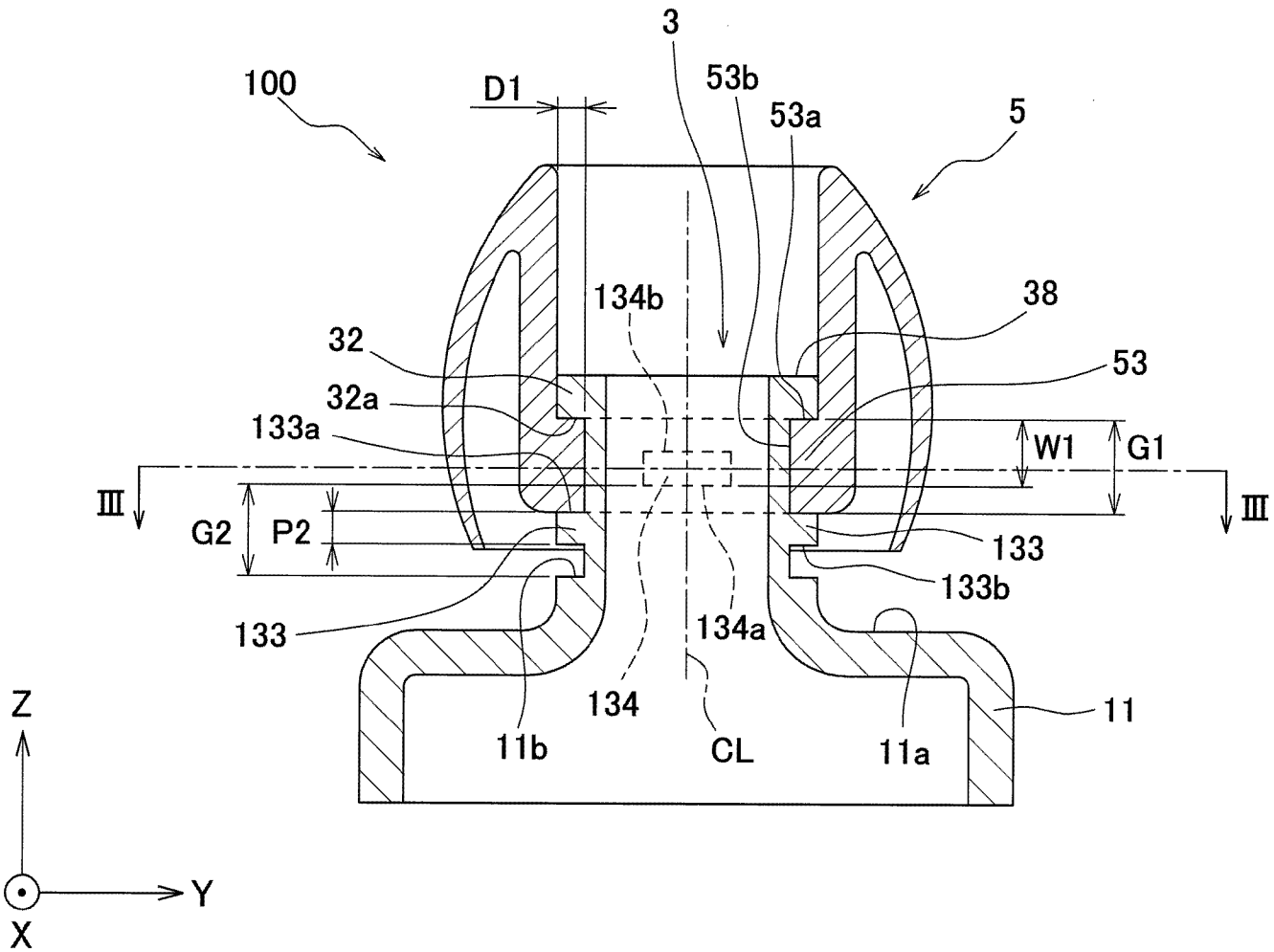
FIG. 2 is a vertical cross section of the earphone device 100 in a first state.
Figure 3:
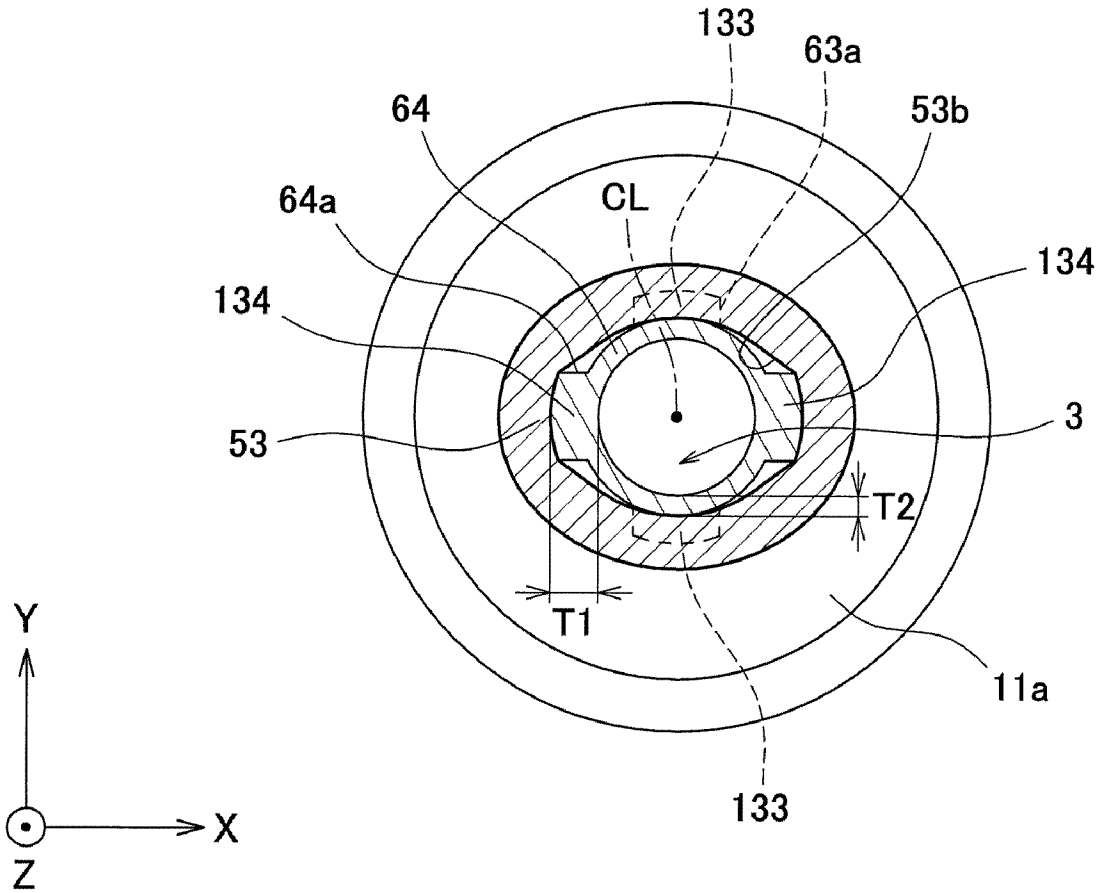
FIG. 3 is a cross section along the line in FIG. 2.

FIG. 1 is an oblique view of the earphone device 100 according to the first embodiment. FIG. 2 is a cross section of the earphone device 100 when the ear tip 5 has been fixed on the distal end side of a sound conduit 3 (that is, in the first state discussed below). In FIG. 2, however, a rear cover 15 and a cord 4 are not depicted. FIG. 3 is a cross section along the III-III line in FIG. 2. A top view of a case main body 10 is also given. Here, a three-dimensionally perpendicular coordinate system O is introduced in FIGS. 1 to 6. With the three-dimensionally perpendicular coordinate system O, the Z axis direction matches the direction of a center line CL (discussed below), the X axis direction matches the direction in which a pair of first projections 134 (discussed below) are opposite each other, and the Y axis direction matches the direction in which a pair of second projections 133 (discussed below) are opposite each other.

As shown in FIGS. 1 and 2, the earphone device 100 has an earphone device main body 1, and the ear tip 5 that can be attached to the earphone device main body 1. The earphone device main body 1 has the case main body 10, a sound generator 2 that is fixed inside the case main body 10, the cord 4, and the sound conduit 3 that extends from the case main body 10.

1.1.1: Case Main Body

The case main body 10 has the rear cover 15 formed in a cup shape from a material that does not readily deform, such as a synthetic resin, and a front cover 11 that is fixed to the rear cover 15.

The rear cover 15 is disposed at a position that can be seen from the outside when the user has put the earphone device 100 in his ear. The rear cover 15 has a cord support 16 for supporting the cord 4. The cord support 16 protrudes from the rear cover 15, and has a hole through which the cord 4 is passed.

The front cover 11, along with the rear cover 15, forms a space for holding the sound generator 2. The front cover 11 has a tubular side face part, a front face 11*a* provided on the opposite side of the side face part from the rear cover 15, and a fourth receiving face 11*b*. The front face 11*a* is disposed so as to face the user side when the user is using the earphone device 100. The front face 11*a* has an opening formed in its approximate center, and is linked to the sound conduit 3 via this opening. The fourth receiving face 11*b* is an annular face formed at the linked portion between the sound conduit 3 and the opening of the front face 11*a*, and is linked to the outer peripheral face 35*a* (discussed below) of a sound conduit main body 35.

The sound generator 2 is a driver unit that produces vibrations according to an inputted voice signal, and generates sound on the basis of a voice signal inputted via the cord 4. The sound generator 2 is housed inside the space formed by the front cover 11 and the rear cover 15.

The cord 4 is connected to the sound generator 2. The cord 4 is also connected to electronic devices such as an audio device for generating voice signals, and transmits voice signals outputted from these electronic devices to the sound generator 2. The cord 4 is guided to the inside of the case main body 10 through a hole formed in the cord support 16.

1.1.2: Sound Conduit

The sound conduit 3 is formed in a substantially tubular shape, protrudes from the front face 11*a* of the front cover 11, and transmits sound generated by the sound generator 2. The sound conduit 3 has the sound conduit main body 35, a flange 32, the first projections 134, and the second projections 133.

Sound Conduit Main Body

The sound conduit main body 35 is a cylinder having a center line CL, and extends in a direction that follows along the center line CL (hereinafter referred to as the center line direction) from the front face 11*a*. The sound conduit main body 35 has the outer peripheral face 35*a* that allows the engaging of a ring part 53 of the ear tip 5. A sound hole 31 is formed in the sound conduit main body 35 as a through-hole that links the inside and outside of the case main body 10 and transmits sound generated by the sound generator 2. As discussed above, an opening is provided in the middle portion of the front face 11*a* of the front cover 11, and the slender sound conduit main body 35 is formed so as to surround this opening. The diameter of the sound conduit main body 35 is set to be smaller than the diameter of the front cover 11. The sound conduit 3 that includes the sound conduit main body 35 is formed integrally with the case main body 10 (more precisely, the front cover 11), for example. The center line CL is also the center line of the sound conduit 3.

Flange

The flange 32 is provided to the end of the sound conduit 3 on the opposite side from the case main body 10, and protrudes from the sound conduit main body 35 in the radial direction of the sound conduit 3. The term "radial direction" here refers to a direction that spreads out radially over a plane perpendicular to the center line direction (an example of the first direction) from the center line CL. As shown in FIG. 1, the flange 32 is provided in annular form so as to encircle the periphery of the outer peripheral face 35*a* of the sound conduit main body 35.

As shown in FIG. 2, the flange 32 has a first receiving face 32*a*. The first receiving face 32*a* is an annular face provided on the case main body 10 side of the flange 32, and is formed substantially perpendicular to the center line direction. When the ear tip 5 is in a first state (discussed below), the flange 32 restricts the movement of the ear tip 5 in the center line direction by bringing the ring part 53 of the ear tip 5 into contact with the first receiving face 32*a*.

An end face 38 is provided on the opposite side of the flange 32 from the case main body 10. The end face 38 is an annular face formed by the flange 32 and the sound conduit main body 35, and is provided substantially perpendicular to the center line direction. The end face 38 is the distal end of the sound conduit 3 on the opposite side from the case main body 10.

First Projections

The first projections 134 (an example of the first restrictor, and an example of the first protruding portion) are a pair of projections that protrude in the radial direction of the sound conduit 3 from the outer peripheral face 35*a* of the sound conduit main body 35, and have a second receiving face 134*a* and a first terrace face 134*b*. As shown in FIG. 2, the first projections 134 are disposed between the flange 32 and the case main body 10 (more precisely, the front face 11*a*). The first projections 134 are formed around the periphery of the sound conduit main body 35, and extend in the peripheral direction.

The pair of first projections 134 are opposite each other in the X axis direction (an example of the second direction) with the center line CL in between. If the sound conduit 3 is cut perpendicular to the center line direction at the locations where the first projections 134 are formed, a first cross section 64 is obtained. The first cross section 64 has a first outer periphery 64*a* (FIG. 3). The first projections 134 are formed such that the length of the first outer periphery 64*a* is greater than the length of the inner periphery of the ring part 53 of the ear tip 5.

The second receiving faces 134*a* are provided on the case main body 10 side of the first projections 134, and are formed substantially perpendicular to the center line direction. When the ear tip 5 is in a second state (discussed below), the first projections 134 restrict the movement of the ear tip 5 in the center line direction (more precisely, the Z axis forward direction) by bringing the ring part 53 of the ear tip 5 into contact with the second receiving faces 134*a*. The first terrace faces 134*b* are provided on the flange 32 side of the first projections 134, and are formed substantially perpendicular to the center line direction.

The first projections 134 here can be formed by adjusting the wall thickness of the sound conduit 3. As shown in FIG. 3, the thickness T1 is the wall thickness of the sound conduit 3 measured at the places where the first projections 134 are formed in the first cross section 64. The thickness T1 is measured in the direction in which the first projections 134 protrude (that is, in the radial direction). The thickness T1 is greater than the thickness T2 shown in FIG. 3. The thickness T2 is the wall thickness of the sound conduit 3 measured at the locations where the first projections 134 are not formed. The measurement location of the thickness T2 here is just an example, and as long as it is a location where the first projections 134 are not formed, the wall thickness measured at some other location may be used as the thickness T2. The wall thickness of the sound conduit 3 in the first cross section 64 is greatest at the places where the first projections 134 are formed.

Second Projections

The second projections 133 (an example of the second restrictor, and an example of the second protruding portion) are a pair of projections that protrude in the radial direction of the sound conduit 3 from the outer peripheral face 35*a* of the sound conduit main body 35, and have a third receiving face 133*a* and a second terrace face 133*b*. As shown in FIG. 2, the second projections 133 are disposed between the first projections 134 and the case main body 10 (more precisely, the front face 11*a*). As shown by the dotted lines in FIG. 3, the second projections 133 are formed around the periphery of the sound conduit main body 35, and extend in the peripheral direction.

The pair of second projections 133 are opposite each other in the Y axis direction (an example of the third direction) with the center line CL in between. That is, the direction in which the pair of second projections 133 are opposite each other is perpendicular to the direction in which the pair of first projections 134 are opposite each other.

Figure 4:
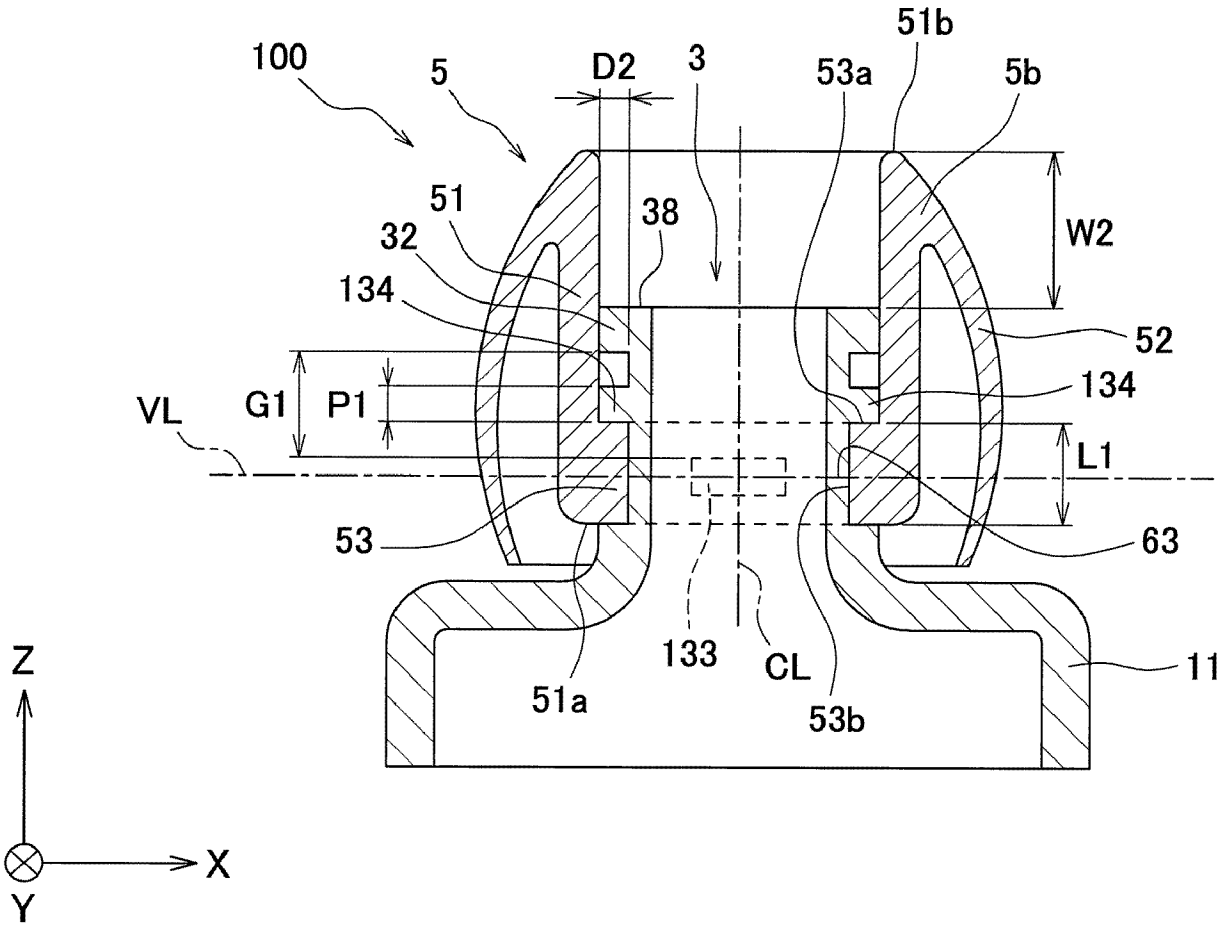
FIG. 4 is a vertical cross section of the earphone device 100 in a second state.

If the sound conduit 3 is cut perpendicular to the center line direction at the locations where the second projections 133 are formed, a second cross section 63 is obtained. For example, the second cross section 63 is obtained by cutting at the location of the virtual line VL (FIG. 4). The second cross section 63 has a second outer periphery 63*a*. The second projections 133 are provided such that the length of the second outer periphery 63*a* of the second cross section 63 is greater than the length of the inner periphery of the ring part 53 of the ear tip 5. As discussed above, the second projections 133 are disposed more to the case main body 10 side than the first projections 134, so the second cross section 63 is more to the case main body 10 side than the first cross section 64.

The third receiving faces 133*a* are provided on the flange 32 side of the second projections 133, and are formed substantially perpendicular to the center line direction. When the ear tip 5 is in the first state, the second projections 133 restrict the movement of the ear tip 5 in the center line direction (more precisely, the Z axis forward direction) by bringing the ring part 53 of the ear tip 5 into contact with the third receiving faces 133*a*. The second terrace faces 133*b* are provided on the case main body 10 side of the second projections 133, and are formed substantially perpendicular to the center line direction.

Just as with the first projections 134, in the second cross section 63 the wall thickness of the sound conduit 3 is greatest at the places where the second projections 133 are formed.

As discussed above, the flange 32 is formed at the end of the sound conduit main body 35, and the first projections 134 for fixing the ear tip 5 are formed at locations on the distal side (that is, on the flange 32 side) of the sound conduit 3. Furthermore, the second projections 133 for fixing the ear tip 5 are formed at locations on the base side (that is, the case main body 10 side) of the sound conduit 3.

The outer peripheral face 35*a* of the sound conduit main body 35, the first projections 134, and the second projections 133 form the outer peripheral part of the sound conduit 3. The ring part 53 of the ear tip 5 can be engaged with the outer peripheral part of the sound conduit 3.

As discussed above, the fourth receiving face 11*b* is an annular face provided more to the case main body 10 side than the second projections 133, and is formed so as to face the flange 32 side. When the ear tip 5 is in the second state, the fourth receiving face 11*b* restricts the movement of the ear tip 5 in the center line direction (more precisely, the Z axis forward direction) by bringing the ring part 53 of the ear tip 5 into contact.

Positional Relation Between First Projections and Second Projections

The positional relation between the first projections 134 and the second projections 133 will now be described.

As shown in FIGS. 2 and 4, the distance G1 is the distance in the center line direction between the third receiving faces 133*a* and the first receiving face 32*a* of the flange 32, and the distance G2 is the distance in the center line direction between the fourth receiving face 11*b* and the second receiving faces 134*a* of the first projections 134. The first projections 134 and the second projections 133 are provided so that the distance G1 and the distance G2 are substantially equal.

Furthermore, the distance G1 is set to be greater than the distance W1 (an example of the first distance) in the center line direction between the first receiving face 32*a* and the second receiving faces 134*a*. As a result, the region in which the distance G1 is measured and the region in which the distance G2 is measured overlap in the center line direction.

The dimension P1 is the dimension of the first projections 134 in the center line direction, and the dimension P2 is the dimension of the second projections 133 in the center line direction. The first projections 134 are formed so that the distance G1 is greater than the dimension P1. Similarly, the second projections 133 are formed so that the distance G2 is greater than the dimension P2.

As mentioned above, the direction in which the first projections 134 are opposite each other is different from the direction in which the second projections 133 are opposite each other. Therefore, the locations where the first projections 134 are disposed when viewed in the center line direction is offset from the locations where the second projections 133 are disposed. Further, as shown in FIG. 3, the first projections 134 and the second projections 133 do not overlap when viewed in the center line direction.

Thus, the first projections 134 and the second projections 133 are formed not as annular projections that go all the way around the outer periphery of the sound conduit main body 35, but rather as projections that are disposed only at certain parts of the outer periphery of the sound conduit main body 35. The first projections 134 and the second projections 133 are disposed at locations that are offset in the center line direction of the sound conduit 3, and are arranged alternately in the peripheral direction of the sound conduit main body 35.

1.1.3: Ear Tip

The ear tip 5 is a cushioning member that can be engaged with the sound conduit 3, and has a tubular part 51, an umbrella-shaped part 52, and the ring part 53.

The ear tip 5 is formed from a soft material so that it will function as a cushioning member. More specifically, the ear tip 5 is formed from a soft rubber, silicone rubber, or other such elastic material. The ring part 53 is formed of a resilient material so that it can be engaged with the sound conduit 3. Normally, an elastic material will be resilient, so the ear tip 5 may be formed by an integral molding method in which an elastic material is used.

The tubular part 51 is formed in a tubular shape, and has a first end 51*a* and a second end 51*b*. The ring part 53 is formed at the first end 51*a*, and the umbrella-shaped part 52 is formed at the second end 51*b*. In a state in which the ear tip 5 is attached to the sound conduit 3, the axial direction of the tubular part 51, that is, the direction facing from the first end 51*a* toward the second end 51*b*, coincides with the center line direction, and the first end 51*a* is disposed on the case main body 10 side.

The umbrella-shaped part 52 is formed so as to cover the tubular part 51, and when the user has put on the earphone device 100, the umbrella-shaped part 52 is in contact with the outer ear canal of the user. The umbrella-shaped part 52 is linked to the second end 51*b* of the tubular part 51, and extends so as to double back from the second end 51*b* toward the first end 51*a*. Therefore, as shown in FIGS. 2 and 4, in a state in which the ear tip 5 is attached to the sound conduit 3, the umbrella-shaped part 52 is disposed so as to cover the sound conduit 3.

The ring part 53 is formed in an annular shape on the first end 51*a* side of the tubular part 51, and can be engaged with the outer peripheral part of the sound conduit 3. As shown in FIG. 2, the ring part 53 protrudes to the inside of the ear tip 5, and can come into contact with the first receiving face 32*a* formed on the flange 32 or the second receiving faces 134*a* formed on the first projections 134. More precisely, the ring part 53 has a first engagement face 53*a* that is formed on the second end 51*b* side and is substantially perpendicular to the axial direction of the ear tip 5 (that is, the axial direction of the tubular part 51). The first engagement face 53*a* can come into contact with the first receiving face 32*a* or the second receiving faces 134*a*.

The ring part 53 also has an inner peripheral face 53*b*. As shown in FIGS. 2 to 4, the inner peripheral face 53*b* touches the outer peripheral part of the sound conduit 3 in a state in which the ear tip 5 is attached to the sound conduit 3.

As shown in FIG. 4, a dimension L1 (an example of a first dimension) is the dimension of the ring part 53 in the axial direction of the ear tip 5. The dimension L1 is set to be substantially equal to the distance G1 in the center line direction between the first receiving face 32*a* and the third receiving faces 133*a*, or to be somewhat less than the distance G1. Since the dimension L1 is set in this way, the ring part 53 can be fitted between the flange 32 and the second projections 133. Similarly, the dimension L1 is set to be substantially equal to the distance G2 in the center line direction between the second receiving faces 134*a* and the fourth receiving face 11*b*, or to be somewhat less than the distance G2. Therefore, the ring part 53 can be fitted between the first projections 134 and the fourth receiving face 11*b*.

The length of the inner periphery of the ring part 53 is set to be less than the second outer periphery 63*a* of the second cross section 63 and the first outer periphery 64*a* of the first cross section 64. Therefore, the ring part 53 is engaged with the outer peripheral part of the sound conduit 3 in a state in which it has been spread out by the outer peripheral part of the sound conduit 3 when attached to the sound conduit 3.

1.2: Attachment of Ear Tip 1.2.1: Ear Tip Attachment State

The state in which the ear tip 5 is attached to the sound conduit 3 in the earphone device 100 will be described through reference to the drawings. With the earphone device 100 according to this embodiment, the ear tip 5 attached to the sound conduit 3 can assume a first state and a second state, according to how it is attached.

In other words, because the second projections 133 for fixing the ring part 53 of the ear tip 5 to the distal end side (that is, the flange 32 side) of the sound conduit 3, and the first projections 134 for fixing this to the base side (that is, the case main body 10 side), are formed, the ear tip 5 can be selectively attached to either the distal end side or the base side of the sound conduit 3.

First State

The ear tip 5 is attached to the sound conduit 3 by pushing the first end 51*a* side of the ear tip 5 against the flange 32 and pushing in the ring part 53 more to the case main body 10 side than the flange 32. The ear tip 5 that has been pushed into the sound conduit 3 enters a first state when the ring part 53 is fitted between the flange 32 and the second projections 133.

FIG. 2 shows the situation when the first state of the ear tip 5 (that is, a state in which the ring part 53 is on the distal end side of the sound conduit 3) has been selected. The cross section shown in FIG. 2 is obtained by cutting the first projections 134 along the ZY plane so as to include the center line CL of the sound conduit 3. FIG. 3 also shows the earphone device 100 when the first state has been selected.

As shown in FIG. 2, in the first state the first engagement face 53*a* of the ring part 53 is opposite the first receiving face 32*a* of the sound conduit 32. Also, the first end 51*a* is located substantially in contact with the third receiving faces 133*a* of the second projections 133. Thus, the ring part 53 is disposed in a state in which there is substantially no gap between the ring part 53 and each of the first receiving face 32*a* and the third receiving faces 133*a*. Even if a force should be exerted on the ear tip 5 in the center line direction, the ring part 53 will hit the first receiving face 32*a* or the third receiving faces 133*a*, and this restricts the movement of the ear tip 5 in the center line direction.

Also, in the first state, the position of the ring part 53 in the center line direction overlaps the position of the first cross section 64. Therefore, as shown in FIG. 3, in the first state at least part of the first outer periphery 64*a* touches the inner peripheral face 53*b* of the ring part 53. In other words, the inner peripheral face 53*b* touches both ends of the first outer periphery 64*a* in the X axis direction and both ends of the first outer periphery 64*a* in the Y axis direction. The two ends of the first outer periphery 64*a* in the X axis direction are a part of the first projections 134. The two ends of the first outer periphery 64*a* in the Y axis direction are a part of the outer peripheral face 35*a* of the sound conduit main body 35.

Thus, in the first state, the ring part 53 of the ear tip 5 is engaged with the sound conduit 3 in a state of being sandwiched between the flange 32 and the second projections 133, and is disposed so as to ride up onto the first projections 134 as indicated by the broken lines (FIG. 2).

In the first state, the ring part 53 is spread out by the outer peripheral part of the sound conduit 3, so tension is generated in the direction in which the ring part 53 contracts. As discussed above, the ring part 53 is formed of a resilient material. Also, the length of the first outer periphery 64*a* is set to be greater than the length of the inner periphery of the ring part 53 so that the ring part 53 can be spread out. Therefore, in the first state, compared to a state in which the ring part 53 has not been attached to the sound conduit 3, the inner periphery of the ring part 53 extends longer, and tension that tries to return the inner periphery to its original length is generated in the ring part 53.

In the first state, the tension generated in the ring part 53 acts in the direction of tightening the outer peripheral part of the sound conduit 3. As a result, the inner peripheral face 53*b* of the ring part 53 is pushed against the outer peripheral face 35*a* of the sound conduit main body 35 and the first projections 134. Therefore, the state in which the ear tip 5 is engaged with the sound conduit 3 can be maintained so long as no force strong enough to balance out the tension produced in the ring part 53 acts in the direction of pulling the ring part 53 apart from the outer peripheral part of the sound conduit 3.

Furthermore, since tension acts on the ring part 53 in the first state, deformation of the ring part 53 is unlikely to occur when a force in the center line direction acts on the ring part 53 via the first receiving face 32*a* of the flange 32. To remove the ear tip 5 from the sound conduit 3 here, it is necessary for a force to be exerted in the Z axis forward direction (an example of the direction of removal from the sound conduit) on the ear tip 5, and the ring part 53 to be deformed while being moved in Z axis forward direction. That is, the ring part 53 must be deformed enough to ride up over the flange 32. However, with the earphone device 100, since the ring part 53 does not readily deform, the ring part 53 cannot ride up over the flange 32 unless a force strong enough to balance out the tension generated at the ring part 53 acts on the ring part 53. To put this another way, since the ring part 53 is tightly engaged with the flange 32, the ear tip 5 does not readily separate from the sound conduit 3.

As discussed above, with a constitution in which the first projections 134 that form the outer peripheral part of the sound conduit 3 are disposed on the left and right of the sound conduit main body 35 (FIG. 3), and the second projections 133 are disposed above and below (FIG. 3), the tension of the ring part 53 of the ear tip 5 is increased when the ring part 53 rides up on the first projections 134. As a result, it is possible to increase the strength with which the ring part 53 engages with the sound conduit 3.

Second State

The ear tip 5 can be moved to farther to the case main body 10 side than in the first state, and fixed to the sound conduit 3. The ear tip 5 that has been pushed into the sound conduit 3 farther than in the first state enters a second state when the ring part 53 is fitted between the first projections 134 and the fourth receiving face 11*b*.

FIG. 4 shows the second state of the ear tip 5 (that is, a state in which the ear tip 5 has moved to the base side of the sound conduit 3). The cross section shown in FIG. 4 is obtained by cutting the first projections 134 in the ZX plane so as to include the center line CL of the sound conduit 3.

As shown in FIG. 4, in the second state the first engagement face 53*a* of the ring part 53 is opposite the second receiving faces 134*a* of the first projections 134. Also, the first end 51*a* is in a position that is substantially in contact with the fourth receiving face 11*b*. Thus, the ring part 53 is disposed in a state in which there is substantially no gap between the ring part 53 and each of the second receiving faces 134*a* and the fourth receiving face 11*b*. Even if a force should be exerted on the ear tip 5 in the center line direction, the ring part 53 will hit the second receiving faces 134*a* or the fourth receiving face 11*b*, and this restricts the movement of the ear tip 5 in the center line direction.

Also, in the second state, the position of the ring part 53 in the center line direction overlaps the position of the second cross section 63 in the center line direction. Therefore, in the second state at least part of the second outer periphery 63*a* touches the inner peripheral face 53*b* of the ring part 53. That is, the inner peripheral face 53*b* touches both ends of the second outer periphery 63*a* in the X axis direction and both ends of the second outer periphery 63*a* in the Y axis direction. The two ends of the second outer periphery 63*a* in the X axis direction are a part of the outer peripheral face 35*a* of the sound conduit main body 35. The two ends of the second outer periphery 63*a* in the Y axis direction are a part of the second projections 133. The second cross section 63 is obtained, for example, by cutting the sound conduit 3 at the location of the virtual line VL in FIG. 4.

Thus, in the second state, the ring part 53 of the ear tip 5 is engaged with the sound conduit 3 in a state of being sandwiched between the fourth receiving face 11*b* and the first projections 134, and is disposed so as to ride up onto the second projections 133.

In the second state, since the ring part 53 is spread out by the outer peripheral part of the sound conduit 3, tension is generated in the direction in which the ring part 53 contracts. The length of the second outer periphery 63*a* is set to be greater than the length of the inner periphery of the ring part 53 so that the ring part 53 can be spread out. Therefore, in the second state, the length of the inner periphery of the ring part 53 is greater than when it has not been attached to the sound conduit 3, and tension is generated in the ring part 53 that attempts to restore the inner periphery to its original length.

In the second state, the tension generated in the ring part 53 acts in the direction of tightening the outer peripheral part of the sound conduit 3. As a result, the inner peripheral face 53*b* of the ring part 53 is pressed against the outer peripheral face 35*a* of the sound conduit main body 35 and the second projections 133. Therefore, a state in which the ear tip 5 is engaged with the sound conduit 3 is maintained so long as no force that would balance out the tension produced at the ring part 53 acts in the direction of pulling the ring part 53 away from the outer peripheral part of the sound conduit 3.

Since the ring part 53 is under tension in the second state, the ring part 53 tends not to undergo deformation in the event that a force in the center line direction is exerted on the ring part 53 via the second receiving faces 134*a* of the first projections 134. Here, a force in the Z axis positive direction must be exerted on the ear tip 5, so that the ring part 53 is deformed while being moved in the Z axis positive direction, in order to remove the ear tip 5 from the sound conduit 3 (or to move it to the first state). That is, the ring part 53 must be deformed enough to ride up over the first projections 134. However, with the earphone device 100, since the ring part 53 tends not to undergo deformation, the ring part 53 cannot ride up over the first projections 134 unless the ring part 53 is subjected to a force that is equivalent to the tension generated by the ring part 53. In other words, since the ring part 53 is tightly engaged with the first projections 134, the ear tip 5 is less apt to become offset in the center line direction.

Furthermore, in the second state, the ring part 53 touches the outer peripheral face 35*a* of the sound conduit main body 35 at the positions where the first projections 134 are disposed when viewed in the center line direction (see FIG. 3). This is because the first projections 134 and the second projections 133 are set to suitable lengths in the peripheral direction, and the direction in which the pair of first projections 134 are opposite each other is offset from the direction in which the pair of second projections 133 are opposite each other. Thus, in the second state, the ring part 53 is fitted all the way in between the first projections 134 and the fourth receiving face 11*b*, so the ring part 53 is securely engaged with the second receiving faces 134*a*.

Bending Portion

As discussed above, the earphone device 100 can assume a first state or second state according to the attachment state of the ear tip 5. In the second state, the ear tip 5 is disposed at a position that is closer to the front face 11*a* of the case main body 10 than in the first state. Thus, with the earphone device 100, the position of the ear tip 5 in the center line direction can be adjusted.

The advantages of being able to adjust the position of the ear tip 5 in the center line direction will now be described. As mentioned above, when the ear tip of an insertion type of earphone device is inserted into the outer ear canal, it is held in the user's hear by friction between the ear tip and the outer ear canal. If the distance of the ear tip from the case main body is not variable, it is not easy to finely adjust the position of the ear tip in the outer ear canal. That is, it is difficult to insert the ear tip tightly enough that it will not come out of the ear, and conversely, to insert it loosely enough that will not be uncomfortable. Therefore, it is desirable that the position of the ear tip with respect to the sound conduit can be adjusted.

In view of this, if the sound conduit is lengthened and two (upper and lower) grooves are provided, the ear tip can be fitted into these grooves, allowing the position of the ear tip to be adjusted. With an earphone device such as this, it is possible to accommodate user preferences, different sizes of outer ear canal, and so forth by adjusting the distance between the case main body and the ear tip in stages. However, the sound conduit has to be lengthened in order to provide the two separate grooves to the sound conduit.

If the sound conduit is longer, then when the ear tip is inserted deep into the sound conduit, the ear tip distal end is less apt to bend, and there is the risk that the ear tip will not adequately perform its function as a cushioning member. If the ear tip does not cushion adequately, the user cannot use the earphone device comfortably. The decrease in cushioning function is particularly pronounced when a small ear tip is attached to the sound conduit, so when the user selects a small ear tip suited to the size of the user's ear, the device may not be pleasant for the user to use.

Meanwhile, with the earphone device 100 according to this embodiment, the length of the sound conduit 3 can be kept short while the position of the ear tip 5 in the center line direction can be adjusted. More specifically, the length of the sound conduit 3 is kept short by overlapping the fixing position of the ring part 53 of the ear tip 5 on the base side with the fixing position on the distal end side. That is, the distance W1 in the center line direction between the first receiving face 32*a* of the flange 32 and the second receiving faces 134*a* of the first projections 134 is set to be less than the dimension L1 of the ring part 53 in the axial direction of the ear tip 5. As a result, as shown in FIGS. 2 and 4, the position of the ring part 53 in the center line direction in the first state partially overlaps the position of the ring part 53 in the center line direction in the second state.

With the earphone device 100, since the length of the sound conduit 3 can thus be kept short, in the second state the distance W2 from the end face 38 of the sound conduit 3 to the second end 51*b* in the center line direction can be increased. In other words, the bending portion 5*b* can be made larger, and the cushioning effect of the ear tip 5 can be enhanced. The bending portion 5*b* referred to here is the portion of the ear tip 5 that is disposed more to the Z axis positive side than the end face 38 of the sound conduit 3 in a state in which the ear tip 5 is attached to the sound conduit 3 (that is, the first state or the second state).

As discussed above, since the amount the sound conduit 3 protrudes from the case main body 10 can be suppressed, it is possible to adjust the position of the ear tip 5 in two stages while still being possible to increase the size of the bending portion 5*b* of the ear tip so that the device can be easily and comfortably worn in the outer ear canal of the user and sound quality can be enhanced.

1.2.2: Mounting

The mounting of the earphone device 100 in the ear of the user will now be described.

When the earphone device 100 is used, the case main body 10 is disposed in a region bounded by the tragus, the ear concha, and antitragus, and the ear tip 5 is inserted so as to be in close contact with the outer ear canal.

Since the ear tip 5, which is formed form a soft rubber or the like, is fitted into the outer ear canal, insertion of the sound conduit 3 into the outer ear canal is accompanied by no pain, so there is no decrease in comfort. In particular, user comfort is improved because the bending portion 5*b* is kept plenty large in the earphone device 100.

Also, with an insertion type of earphone device, since the ear tip 5 blocks the outer ear canal, the low-volume reproduction performance is excellent. That is, an insertion type of earphone device can reproduce sounds in the low-volume band relatively more faithfully. In particular, with the earphone device 100 according to this embodiment, since a large size is ensured for the bending portion 5*b*, the ear tip 5 can be easily brought into snug contact with the outer ear canal by deforming the bending portion 5*b*. That is, the ear tip 5 can effectively block the outer ear canal, and sound leakage can be reduced. As a result, there is a further increase in the reproduction of sound in the low-volume band with the earphone device 100. Thus, the earphone device 100 is compact, but offers low sound leakage and good sound blockage, so the sound quality is good.

1.3: Effects

The effects of the earphone device 100 according to the first embodiment will now be compiled.

(1)

With this earphone device 100, since the length of the first outer periphery 64*a* of the sound conduit 3 is greater than the length of the inner periphery of the ring part 53, the ring part 53 can be engaged snugly with the sound conduit 3. As a result, the ear tip 5 and the sound conduit 3 are bound more strongly together, and the ear tip 5 can be more securely attached to the sound conduit 3.

(2)

With this earphone device 100, when the ear tip 5 is in the first state, at least part of the first outer periphery 64*a* touches the inner peripheral face 53*b* of the ring part 53, so the ring part 53 is spread out by the sound conduit 3, and tension is generated in the ring part 53 in the direction of tightening the sound conduit 3. Since the ring part 53 is pressed against the sound conduit 3 by the tension thus generated, and the ring part 53 is engaged snugly with the sound conduit 3, the ear tip 5 can be securely attached to the sound conduit 3.

(3)

With this earphone device 100, the ear tip 5 can assume a second state in which the ring part 53 is disposed more to the case main body 10 side than the first cross section 64, and movement with respect to the sound conduit 3 is restricted. That is, when the ear tip 5 is attached to the sound conduit 3, it can be attached at a different position from that in the first state. Since the position of the ear tip 5 can thus be adjusted with respect to the sound conduit 3, the device is more convenient for the user.

(4)

With this earphone device 100, there is a second cross section 63 that is disposed at a different position from that of the first cross section 64 and is substantially perpendicular to the center line direction, and the length of the second outer periphery 63*a* of the second cross section 63 is greater than the length of the inner periphery of the ring part 53, so the ear tip 5 can be securely fixed to the sound conduit 3 even at positions other than the first cross section 64. Since the attachment mode of the ear tip 5 to the sound conduit 3 can thus be selected, the ear tip 5 can be securely engaged with the sound conduit 3 in any mode.

(5)

With this earphone device 100, when the ear tip 5 is in the second state, at least part of the second outer periphery 63*a* is in contact with the inner peripheral face 53*b* of the ring part 53, so the ring part 53 is reliably spread out by the sound conduit 3, and tension is generated in the ring part 53 in the direction of tightening the sound conduit 3. Since the ring part 53 is pressed against the sound conduit 3 by the tension thus generated, and the ring part 53 is engaged snugly with the sound conduit 3, the ear tip 5 can be securely attached to the sound conduit 3.

(6)

With this earphone device 100, since the first projections 134, which protrude in the radial direction from the sound conduit main body 35, are provided at positions corresponding to the first cross section 64, the ring part 53 is reliably spread out by the first projections 134 and snugly engaged with the sound conduit 3.

(7)

With this earphone device 100, since the second projections 133, which protrude in the radial direction from the sound conduit main body 35, are provided at positions corresponding to the second cross section 63, the ring part 53 is reliably spread out by the second projections 133 and snugly engaged with the sound conduit 3.

(8)

With this earphone device 100, since the first projections 134 and the second projections 133 are disposed so as to be offset from one another when viewed in the center line direction, the ring part 53 can be securely engaged with the first projections 134 even when the ring part 53 has been spread out by the second projections 133. Therefore, in the second state, movement of the ring part 53 in the center line direction is restricted by the first projections 134, and the ring part 53 is pressed against the sound conduit 3 by the tension generated at the ring part 53. As a result, even in the second state the ear tip 5 can be securely engaged with the sound conduit 3.

(9)

With this earphone device 100, since the first projections 134 has the second receiving faces 134*a*, when the ring part 53 hits the second receiving faces 134*a* in the second state, movement of the ear tip 5 in the center line direction is reliably restricted. Thus, the ear tip 5 can be securely attached to the sound conduit 3 in the second state.

(10)

With this earphone device 100, since the distance W1 in the center line direction from the first receiving face 32*a* to the second receiving faces 134*a* is less than the dimension L1 of the ring part 53 in the axial direction of the ear tip 5, the position of the ring part 53 in the first state partially overlaps the position of the ring part 53 in the second state in the center line direction. Thus, the length of the sound conduit 3 in the center line direction can be reduced while the position of the ear tip 5 with respect to the sound conduit 3 in the center line direction can be adjusted in stages. As a result, the bending portion 5*b* of the ear tip 5 can be made larger, which improves the function of the ear tip 5 as a cushioning member.

In other words, with the earphone device 100, it is possible to accommodate user preferences, different sizes of outer ear canal, and so forth by changing the distance between the case main body 10 and the ear tip 5 in stages. Also, since the ear tip 5 can be securely fixed to the sound conduit 3 and, at the same time, the protrusion of the sound conduit 3 from the case main body 10 can be suppressed, the device is easier to put on and its sound quality is improved.

(11)

With this earphone device 100, since the second projections 133 have the third receiving faces 133*a*, when the ring part 53 hits the third receiving faces 133*a* in the first state, movement of the ear tip 5 in the center line direction can be restricted. That is, the position of the ear tip 5 with respect to the sound conduit 3 can be stabilized.

Second Embodiment

In the first embodiment, the first terrace faces 134*b* that are substantially perpendicular to the center line direction are provided to the first projections 134, but faces that are inclined to the center line direction may be provided instead of the first terrace faces 134*b*. Similarly, faces that are inclined to the center line direction may be provided instead of the second terrace faces 133*b*.

Figure 5:
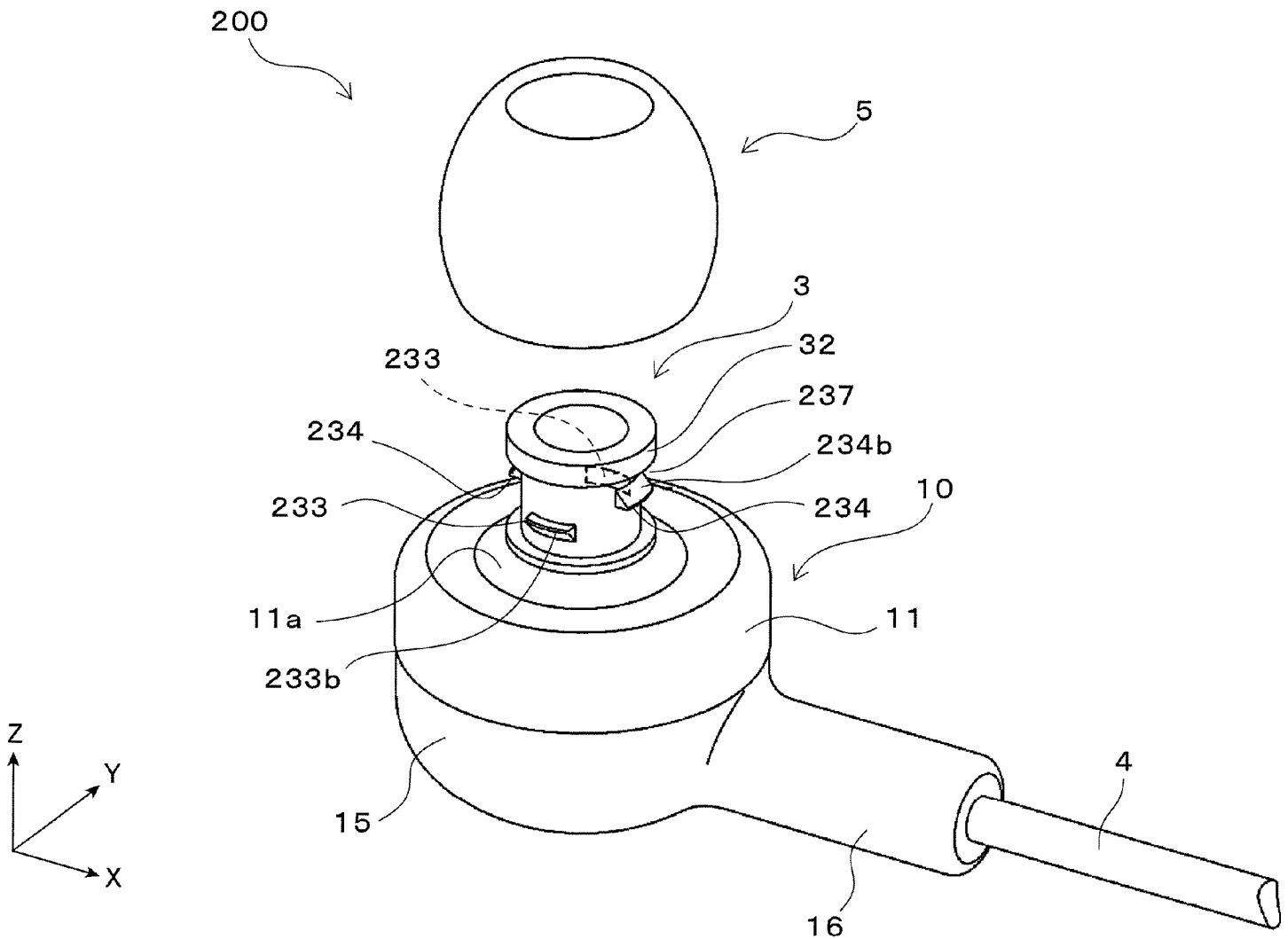
FIG. 5 is an oblique view of an earphone device 200 in a state in which the ear tip 5 has not been attached.

The earphone device 200 according to the second embodiment will now be described through reference to FIGS. 5 and 6. Those components that are substantially the same as in the first embodiment will be numbered the same, and will not be described again.

The earphone device 200 is obtained by replacing the first projections 134 in the earphone device 100 with first projections 234 (an example of the first restrictor, and an example of first projections), and replacing the second projections 133 with second projections 233 (an example of the second restrictor, and an example of second projections).

The first projections 234 have second receiving faces 134*a* and first inclined faces 234*b*. The first inclined faces 234*b* are obtained by inclining the first terrace faces 134*b* of the earphone device 100 so that they move closer to the second receiving faces 134*a* as they move farther away from the center line CL in the radial direction.

Figure 6:
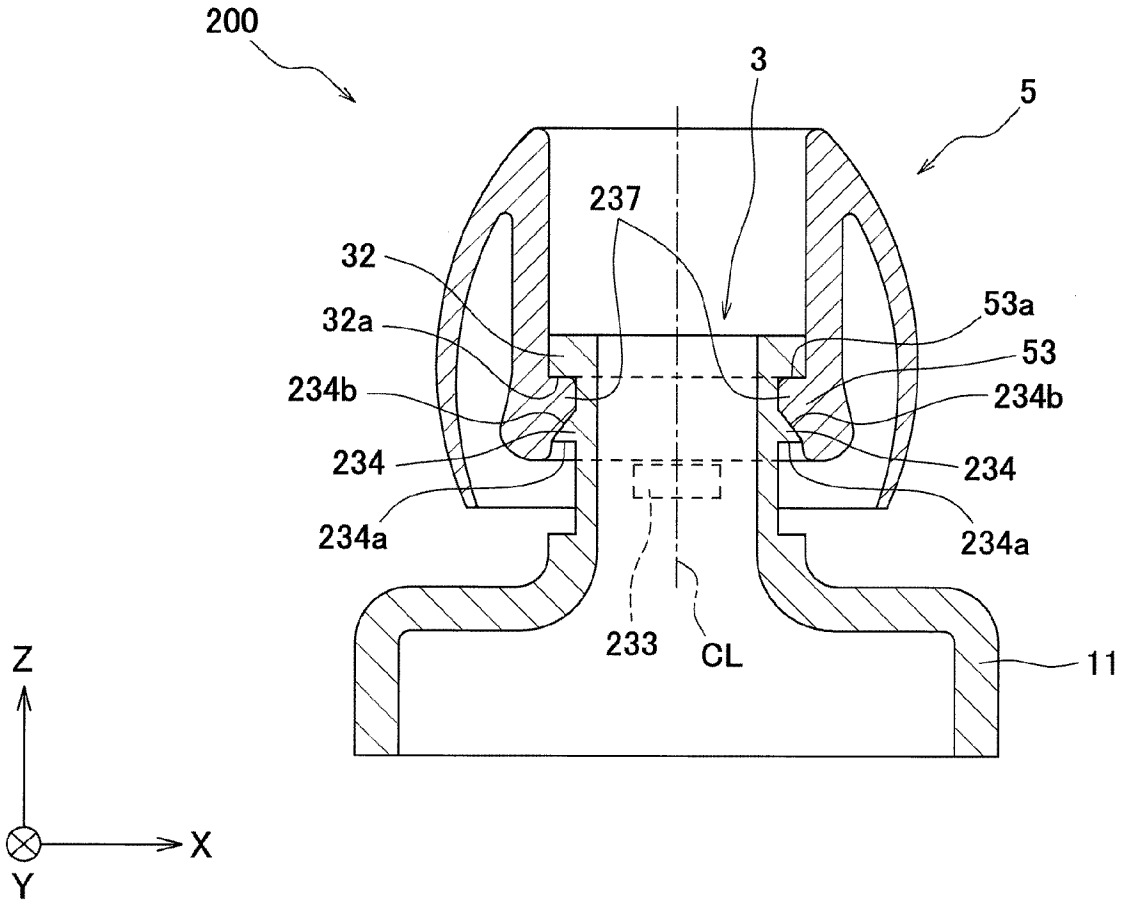
FIG. 6 is a vertical cross section of the earphone device 200 in a first state.

FIG. 6 illustrates the earphone device 200 when the ear tip 5 is in the first state. That is, in FIG. 6, the ring part 53 is fitted between the flange 32 and the second projections 233, and rides up over the first projections 234. As shown in FIG. 6, the first inclined faces 234*b* are inclined so as to move away from the center line CL as the case main body 10 side is approached. In other words, the first inclined faces 234*b* are inclined so as to face the flange 32 side.

Meanwhile, when the ring part 53 generates tension in the direction of tightening the first projections 234, resistance from the first inclined faces 234*b* is exerted on the ring part 53. Because the first inclined faces 234*b* are inclined so as to face the flange 32 side, the resistance from the first inclined faces 234*b* exerted on the ring part 53 includes a component whose orientation is toward the flange 32 side in the center line direction (that is, the Z axis positive direction). As a result, the ring part 53 is subjected to a force toward the flange 32 side in the center line direction, and the ring part 53 is pressed against the first receiving face 32*a* of the flange 32. The force with which the ring part 53 pushes the outer peripheral part of the sound conduit 3 is converted by the first inclined faces 234*b* into a force that pushes the ring part 53 out to the flange 32 side in the center line direction.

When the ring part 53 is pressed against the first receiving face 32*a*, a state is maintained in which the first receiving face 32*a* and the first engagement face 53*a* of the ring part 53 are opposite each other. Since the first engagement face 53*a* and the first receiving face 32*a* are thus in close contact, movement of the ear tip 5 in the center line direction is effectively prevented, and the position of the ear tip 5 is stable. This prevents the ear tip 5 from falling out of the sound conduit 3.

Also, since the first inclined faces 234*b* are inclined so as to approach the second receiving faces 134*a* as they move away from the center line CL, the width in the center line direction of the gap 237 formed between the first inclined faces 234*b* and the first receiving face 32*a* of the flange 32 increases moving away from the center line CL. Since the outside of the gap 237 in the radial direction is thus open, it is easier for the ring part 53 to enter the gap 237. When the ring part 53 enters the gap 237, the first engagement face 53*a* of the ring part 53 and the first receiving face 32*a* of the flange 32 can be reliably made to oppose each other in the first state. That is, even in a state in which the ring part 53 rides up over the first projections 234, offset in the radial direction between the first receiving face 32*a* and the first engagement face 53*a* can be suppressed. Thus, with the earphone device 200, since the ring part 53 securely engages with the flange 32, the ear tip 5 is less likely to fall out of the sound conduit 3.

As discussed above, the earphone device 200 according to the second embodiment is constituted such that the cross sectional shape of the first projections 234 is triangular (FIG. 6). Therefore, the tension generated at the ring part 53 increases when the ring part 53 of the ear tip 5 rides up on the distal ends of the first projections 234 formed in this triangular shape. Furthermore, since the ring part 53 is fixed while being biased toward the flange 32 and the outer peripheral face 35*a* side along the triangular inclined faces, it is securely hooked onto the flange 32. As a result, with the earphone device 200 the ear tip 5 and the sound conduit 3 can be engaged together more tightly.

The second projections 233 have the third receiving faces 133*a* and second inclined faces 233*b*. With the earphone device 100, the second inclined faces 233*b* are obtained by inclining the second terrace faces 133*b* so that they move closer to the third receiving faces 133*a* as they move farther away from the center line CL in the radial direction. Thus, the second projections 233 have a tapered shape that narrows in its width in the center line direction moving away from the center line CL. Therefore, in the second state in which the ring part 53 has ridden up on the second projections 233, the second projections 233 engage with the inner peripheral face 53*b* of the ring part 53, so the ear tip 5 is securely fixed to the sound conduit 3.

Other Embodiments

The specific constitution of the earphone device disclosed herein is not limited to or by the embodiments given above, and various changes and modifications are possible without altering the gist of the invention.

(A)

In the above embodiments, the sound conduit main body 35 was a cylinder, but the sound conduit main body 35 may be some other shape besides cylindrical. That is, the sound conduit main body 35 only needs to be tubular, and a cross section of the sound conduit main body 35 may be elliptical, or it may be polyhedral, for example.

(B)

In the above embodiments, the first projections 134 (or first projections 234) and the second projections 133 (or second projections 233) were formed in pairs, but the number of constituent elements of the projections is not necessarily two. A cross section having an outer periphery that is longer than the inner periphery of the ring part 53 may be obtained by providing projections to the sound conduit main body 35. Therefore, the number of projections included in the first projections 134 (or first projections 234) may be one, or may be three or more. Similarly, the number of projections included in the second projections 133 (or second projections 233) may be one, or may be three or more.

(C)

In the above embodiments, the first projections 134 (or first projections 234) and the second projections 133 (or second projections 233) were formed only on part of the sound conduit main body 35 when viewed in the center line direction. For example, the dimension in the peripheral direction of each of the two projections constituting the first projections 134 was set to be about one-eighth to one-sixth the length around the sound conduit main body 35 (see FIG. 3).

However, the dimension of each of these projections in the peripheral direction is not limited to being the dimensions given in the above embodiments. That is, as long as secure engagement with the ring part 53 is possible, dimensions other than those given in the above embodiments may be set as the dimensions of the first projections 134 (or first projections 234) and the second projections 133 (or second projections 233).

(D)

In the above embodiments, the flange 32 was provided in annular form so as to go all the way around in the peripheral direction of the sound conduit main body 35, but may instead be formed only on part of the sound conduit main body 35 around the peripheral direction. That is, the flange 32 may be provided in a size that is large enough for the movement of the ear tip 5 in the center line direction to be restricted by contact with the ring part 53.

(E)

Also, the width of the flange 32 in the radial direction, measured from the outer peripheral face 35*a* of the sound conduit main body 35 (hereinafter referred to as the projection width) need not be uniform along the peripheral direction of the sound conduit main body 35. For instance, the projection width D1 (FIG. 2) in the direction in which the second projections 133 protrude (that is, the Y axis direction) may be set to be greater than the projection width D2 (FIG. 4) in the direction in which the first projections 134 protrude (that is, the X axis direction). Thus providing the flange 32, as shown in FIG. 3, results in the projection width of the flange 32 being greater at the position where the ring part 53 touches the outer peripheral face 35*a* of the sound conduit main body 35. As a result, the ring part 53 securely engages with the flange 32 in the first state, so the likelihood that the ear tip 5 will fall out of the sound conduit 3 can be effectively reduced.

(F)

In the above embodiments, two projections (namely, the first projections 134 and the second projections 133) were provided in the center line direction, but three or more projections may be provided.

More specifically, it is possible to provide more projections at positions that are offset in the center line direction from the first projections 134 and the second projections 133 so that the positions where the ear tip 5 (more precisely, the ring part 53) is fixed will overlap in the center line direction. Thus arranging three or more projections in the center line direction makes it possible for the positions where the ear tip is attached to the sound conduit to be adjusted in stages more finely.

INDUSTRIAL APPLICABILITY

The earphone device discussed above is useful because it can be used in portable audio devices, for example.

EXPLANATION OF REFERENCE

100 earphone device (first embodiment)
1 earphone device main body
2 sound generator
10 case main body
11 front cover
11*a* front face
11*b* fourth receiving face
15 rear cover
16 cord support
3 sound conduit
31 sound hole
32 flange
32*a* first receiving face
35 sound conduit main body
35*a* outer peripheral face
38 end face

133 second projection (an example of a second protruding portion)
133*a* third receiving face
133*b* second terrace face
134 first projection (an example of a first protruding portion)
134*a* second receiving face
134*b* first terrace face
4 cord
5 ear tip
5*b* bending portion
51 tubular part
51*a* first end
51*b* second end
52 umbrella-shaped part
53 ring part
53*a* first engagement face
53*b* inner peripheral face
63 second cross section
63*a* second outer periphery
64 first cross section
64*a* first outer periphery
200 earphone device (second embodiment)
233 second projection (an example of a second protruding portion)
233*b* second inclined face
234 first projection
234*b* first inclined face
237 gap

The invention claimed is:

1. An earphone device, comprising:
a case main body;
a sound conduit formed in a substantially tubular shape and protruding from the case main body, the sound conduit having a flange disposed at the end on the opposite side from the case main body, and a first restrictor disposed between the flange and the case main body; and
an ear tip having a ring part formed of a resilient material and configured to be engaged to the sound conduit, the ear tip configured to be in a first state in which movement in the direction of removal from the sound conduit is restricted by the flange, and configured to be in a second state in which movement in the direction of removal from the sound conduit is restricted by the first restrictor.

2. The earphone device according to claim 1,
wherein the length of a first outer periphery of the sound conduit at the position of the first restrictor is greater than the length of the inner periphery of the ring part, and
in the first state of the ear tip, the inner periphery of the ring part is in contact with at least part of the first outer periphery.

3. The earphone device according to claim 2,
wherein the first restrictor has a shape protruding in the radial direction of the sound conduit, and forms at least part of the first outer periphery.

4. The earphone device according to claim 2,
wherein the sound conduit has a second restrictor disposed between the first restrictor and the case main body,
the length of a second outer periphery of the sound conduit at the position of the second restrictor is greater than the length of the inner periphery of the ring part, and
in the second state of the ear tip, the inner periphery of the ring part is in contact with at least part of the second outer periphery.

5. The earphone device according to claim 4,
wherein, in the first state, movement of the ear tip to the case main body side is restricted by contact with the second restrictor.

6. The earphone device according to claim 5,
wherein, in the second state, movement of the ear tip to the case main body side is restricted by contact with the case main body.

7. The earphone device according to claim 5,
wherein the first restrictor has a shape protruding in the radial direction of the sound conduit, and forms at least part of the first outer periphery.

8. The earphone device according to claim 4,
wherein, in the second state, movement of the ear tip to the case main body side is restricted by contact with the case main body.

9. The earphone device according to claim 4,
wherein the first restrictor has a shape protruding in the radial direction of the sound conduit, and forms at least part of the first outer periphery.

10. The earphone device according claim 4,
wherein the second restrictor has a shape protruding in the radial direction of the sound conduit, and forms at least part of the second outer periphery.

11. The earphone device according to claim 4,
wherein the first restrictor has a pair of first protrusions opposite each other with the center line of the sound conduit in between,
the second restrictor has a pair of second protrusions opposite each other with the center line of the sound conduit in between, and
the direction in which the first protrusions face each other is shifted from the direction in which the second protrusions face each other.

12. The earphone device according to claim 1,
wherein the sound conduit has a second restrictor disposed between the first restrictor and the case main body,
the length of a second outer periphery of the sound conduit at the position of the second restrictor is greater than the length of the inner periphery of the ring part, and
in the second state of the ear tip, the inner periphery of the ring part is in contact with at least part of the second outer periphery.

13. The earphone device according to claim 12,
wherein, in the first state, movement of the ear tip to the case main body side is restricted by contact with the second restrictor.

14. The earphone device according to claim 13,
wherein, in the second state, movement of the ear tip to the case main body side is restricted by contact with the case main body.

15. The earphone device according to claim 13,
wherein the first restrictor has a shape protruding in the radial direction of the sound conduit, and forms at least part of the first outer periphery.

16. The earphone device according to claim 13,
wherein the first restrictor has a pair of first protrusions opposite each other with the center line of the sound conduit in between,
the second restrictor has a pair of second protrusions opposite each other with the center line of the sound conduit in between, and
the direction in which the first protrusions face each other is shifted from the direction in which the second protrusions face each other.

17. The earphone device according to claim 12, wherein, in the second state, movement of the ear tip to the case main body side is restricted by contact with the case main body.

18. The earphone device according claim 12, wherein the second restrictor has a shape protruding in the radial direction of the sound conduit, and forms at least part of the second outer periphery.

19. The earphone device according to claim 12, wherein the first restrictor has a pair of first protrusions opposite each other with the center line of the sound conduit in between, the second restrictor has a pair of second protrusions opposite each other with the center line of the sound conduit in between, and the direction in which the first protrusions face each other is shifted from the direction in which the second protrusions face each other.

20. The earphone device according to claim 12, wherein the first restrictor has a shape protruding in the radial direction of the sound conduit, and forms at least part of the first outer periphery.

* * * * *